US006579156B2

(12) United States Patent
Sugino et al.

(10) Patent No.: US 6,579,156 B2
(45) Date of Patent: Jun. 17, 2003

(54) METHOD OF WORKING HUB RING OF WHEEL BEARING ASSEMBLY

(75) Inventors: Keiichi Sugino, Shizuoka (JP); Yutaka Yamauchi, Shizuoka (JP); Eiji Ito, Shizuoka (JP); Nobuhiko Tsuji, Shizuoka (JP)

(73) Assignee: NTN Corporation, Osaka (JP)

( * ) Notice: Subject to any disclaimer, the term of this patent is extended or adjusted under 35 U.S.C. 154(b) by 69 days.

(21) Appl. No.: 09/930,232

(22) Filed: Aug. 16, 2001

(65) Prior Publication Data

US 2002/0023350 A1 Feb. 28, 2002

(30) Foreign Application Priority Data

Aug. 25, 2000 (JP) ..... 2000-255911

(51) Int. Cl.[7] ..... B24B 1/00; B24B 7/19; B24B 7/30

(52) U.S. Cl. ..... 451/52; 29/898.066

(58) Field of Search ..... 451/49, 52, 51; 29/898.066, 898.063; 279/53, 133; 384/544

(56) References Cited

U.S. PATENT DOCUMENTS 4,506,422 A * 3/1985 Egusa ..... 29/898.066
6,428,214 B2 * 8/2002 Tajima et al. ..... 384/544

FOREIGN PATENT DOCUMENTS

JP 2000-71705 * 3/2000 ..... B60B/27/02
JP 2001-138704 * 5/2001 ..... B60B/35/02

* cited by examiner

*Primary Examiner*—Dung Van Nguyen
(74) *Attorney, Agent, or Firm*—Wenderoth, Lind & Ponack, L.L.P.

(57) ABSTRACT

The aim is to make unnecessary secondary turning of a hub ring of a wheel bearing assembly by improving the run-out accuracy of a wheel-mounting flange and the coaxiality of the brake pilot portion. With the brake pilot portion of the wheel-mounting flange clamped and with a backing plate in abutment with an outer peripheral portion of the wheel-mounting flange, by axially biasing an end face of the small-diameter portion of the hub ring with a pressure clamp, at least the bearing raceway of the hub ring is ground with the outer side face of the wheel-mounting flange as a reference surface.

24 Claims, 7 Drawing Sheets

METHOD OF WORKING HUB RING OF WHEEL BEARING ASSEMBLY

BACKGROUND OF THE INVENTION

This invention relates to a method of working a hub ring of a wheel bearing assembly and a device therefor.

Among vehicle wheel bearing assemblies, there are ones for driving wheels and ones for non-driving wheels. FIG. 6 shows one example. This wheel bearing assembly is for a driving wheel and comprises an outer member 1, an inner member 2 and double-row rolling elements 3 mounted between outer and inner members 1 and 2.

On the outer periphery of the outer member 1, a vehicle body-mounting flange 4 is formed, and on inner periphery thereof, double-row bearing raceways 5 are formed.

The inner member 2 comprises a hub ring 2*a* as a first rotary member and a raceway member 2*b* as a second rotary member. On the outer periphery of the hub ring 2*a*, a wheel-mounting flange 6 and a bearing raceway 7 opposite one of two bearing raceways 5 formed on the outer member 1 are formed. Hub bolts 8 are provided on the wheel-mounting flange 6. On the outer side of the hub ring 2*a*, a wheel pilot portion 9*a* and a brake pilot portion 9*b* are provided. The latter is located at the root of the wheel-mounting flange 6. On the inner side, a small-diameter portion 10 is provided. The hub ring 2*a* is formed with a spline through hole 11 extending from the end face of the small-diameter portion 10 to the bottom of the wheel pilot portion 9*a*.

On the outer peripheral surface of the small-diameter portion 10 of the hub ring 2*a*, a fitting surface 10*a* receiving the raceway member 2*b*, the raceway 7, and a seal land 10*b* are formed. On the raceway member 2*b*, a bearing raceway 12 opposite the other of the double-row bearing raceways 5 formed on the outer member 1 is formed.

The double-row rolling elements 3 are mounted between the double-row bearing raceways 5 provided on the inner periphery of the outer member 1 and the bearing raceway 7 and 12 formed on the hub ring 2*a* and raceway member 2*b*, respectively, to support the outer member 1 and the inner member 2 rotatably. Also, seals S are mounted at both ends between opposed surfaces of the outer member 1 and the inner member 2 to prevent entry of dust.

In mounting the wheel bearing assembly to a vehicle, the flange 4 formed on the outer member 1 is secured to the vehicle body by tightening bolts.

Also, wheel nuts 14 are tightened onto the hub bolts 8 provided on the wheel-mounting flange 6 to mount a brake rotor 13 and a disc wheel to the wheel-mounting flange 6.

In such a wheel bearing assembly, since run-out of the braking surface 13*a* of the brake rotor 13 during rotation causes brake judder during braking, high working accuracy and high dimensional accuracy are required for each part of the wheel bearing assembly.

In particular, since the outer side of the wheel-mounting flange 6 of the hub ring 2*a* is the mounting surface for the brake rotor 13, the working accuracy of the hub ring 2*a* influences the run-out of the brake rotor 13.

Heretofore, as shown in FIG. 7, in grinding the hub ring 2*a*, a backing plate 20 was pressed against the wheel pilot portion 9*a*, the bearing raceway 7 was supported by a shoe 21 with the end face of the wheel pilot portion 9*a* as a reference, and the bearing raceway 7, the fitting surface 10*a* for the raceway member 2*b*, and the seal land 10*b* were simultaneously ground by use of a grinder 22.

But if grinding is done with the end face of the wheel pilot portion 9*a* as a reference, it is impossible to ensure run-out accuracy of the brake rotor mounting surface of relative to the bearing raceway 7 (that is, rotation center), and the coaxiality of the brake pilot portion 9*b*.

Thus, heretofore, as measures for reducing run-out of the wheel-mounting flange 6 with the hub ring 2*a* alone, after grinding, secondary turning with the fitting surface 10*a* and abutment surface for the raceway member 2*b* as a reference was necessary.

An object of this invention is to provide a method and apparatus of working a hub ring in a wheel bearing assembly which can improve the runout accuracy of the flange surface to which a brake rotor is mounted and the coaxiality of the brake pilot portion to make secondary turning of the hub wheel unnecessary.

SUMMARY OF THE INVENTION

According to this invention, there is provided a method of working a hub ring of a wheel bearing assembly having integrally a wheel-mounting flange, a brake pilot portion protruding from the root of the wheel-mounting flange, and a small-diameter portion formed with a bearing raceway on outer periphery thereof, wherein with the brake pilot portion of the hub ring clamped, with a backing plate in abutment with an outer side face of the wheel-mounting flange, by axially biasing an end face of the small-diameter portion of the hub ring with a pressure clamp, at least the bearing raceway of the hub ring is ground with the outer side face of the wheel-mounting flange as a reference surface.

By grinding at least the bearing raceway of the hub ring with the outer side face of the wheel-mounting flange as a reference surface, it is possible to restrain the run-out of the wheel-mounting flange relative to the bearing raceway.

Also, because the hub ring is clamped by holding the brake pilot portion of the hub ring and axially biasing the end face of the small-diameter portion of the hub ring with the pressure clamp, the axis center accuracy of the hub ring is high and the coaxiality of the brake pilot portion improves.

The rotary grinding device for a hub ring according to this invention includes a clamp device for the hub ring comprising a chucking device for holding the brake pilot portion of the hub ring, a backing plate to be brought into abutment with an outer side face of the wheel-mounting flange, a pressure clamp for axially biasing an end face of the small-diameter portion of the hub ring, and a grinder used in abutment with at least the bearing raceway of the hub ring. With this device, since at least the bearing raceway is ground while ensuring the axis center accuracy of the hub ring with the outer side of the wheel-mounting flange as a reference surface, it is possible to restrain the run-out of the wheel-mounting flange relative to the bearing raceway and ensure the coaxiality of the brake pilot portion.

By supporting the outer peripheral portion of the wheel-mounting flange with the backing plate, rotary support of the hub ring stabilizes more, so that high-precision grinding is assured.

If the backing plate and the wheel-mounting flange are brought not into entire surface abutment but partial abutment by a single or a plurality of support portions, the contact area decreases, so that it is possible to grind the hub ring without being influenced by the working accuracy of the wheel-mounting flange in the preceding step.

Also, by providing air nozzles in the support portions of the backing plate to remove foreign matter adhering to the support portion of the backing plate or the clamp portion of the brake pilot portion by air blown from the air nozzles, it is possible to prevent poor fitting due to biting of foreign matter.

Also, by forming a closed space inside with the backing plate in abutment with the outer side of the wheel-mounting flange, blowing air from the air nozzles into the closed space, detecting the air pressure, and checking for the presence of foreign matter based on the air pressure, it is possible to confirm the fitting state of the hub ring on the working device. That is to say, if foreign matter bites between the wheel-mounting flange and the backing plate, or if the hub ring is fitted obliquely, a gap is formed between the wheel-mounting flange and the backing plate, so that air leaks through the gap and the air pressure drops. Thus, by monitoring the air pressure, it is possible to check for fitting trouble of the hub ring.

Also, by providing a clamp head which can pivot its head at the tip of the pressure clamp for axially biasing the end face of the small-diameter portion of the hub ring, it is possible to suitably maintain the biasing direction of the pressure clamp to the center of axis without being influenced by the working accuracy of the end face of the small-diameter portion of the hub ring.

Other features and objects of the present invention will become apparent from the following description made with reference to the accompanying drawings, in which:

DETAILED DESCRIPTION OF THE PREFERRED EMBODIMENT

Hereinbelow, the embodiments of this invention will be described with reference to the drawings.

Figure 1:
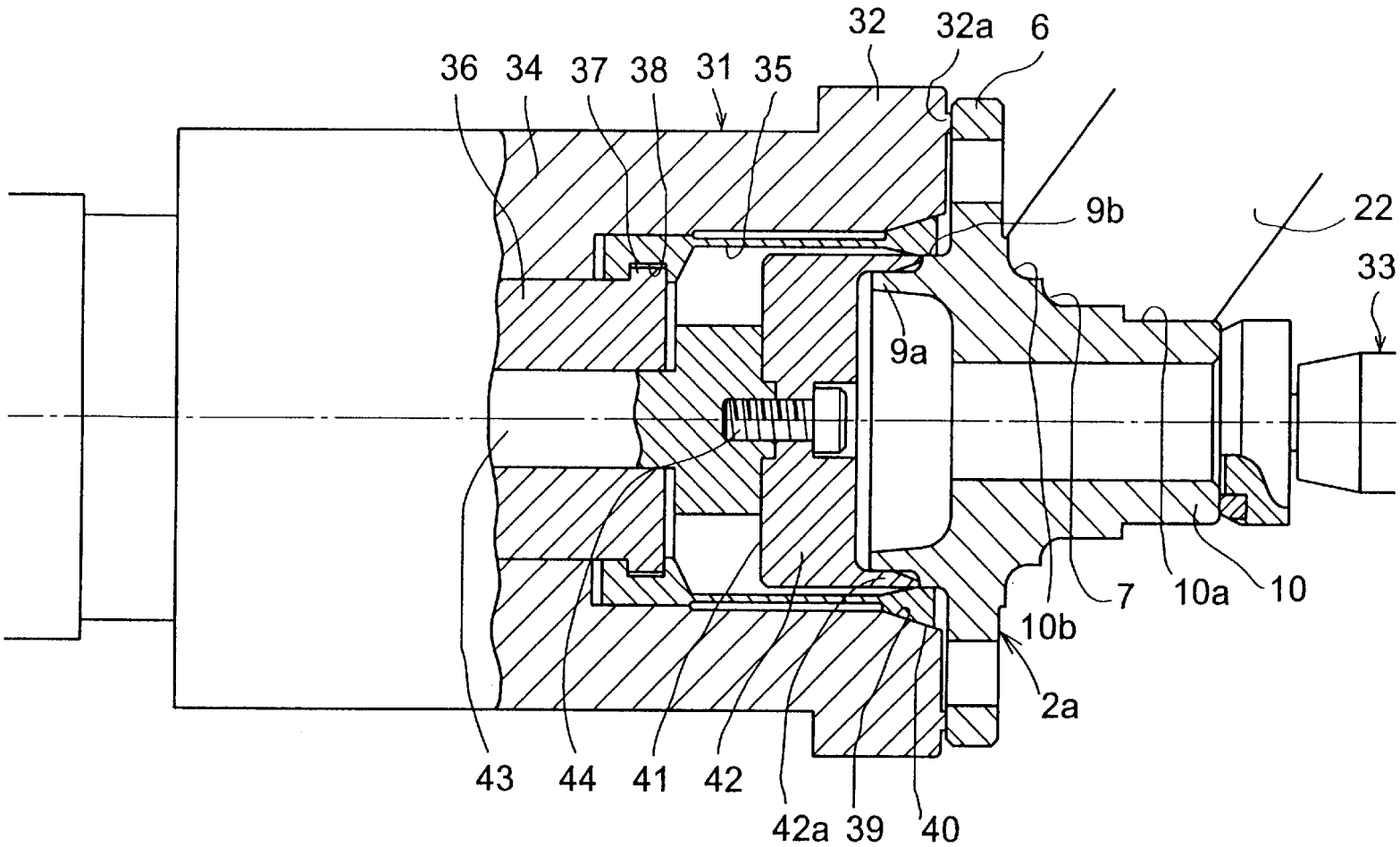
FIG. 1 is a partially enlarged cross-sectional plan view of a rotary grinding device according to this invention.

The rotary grinding device shown in FIG. 1 is designed to simultaneously grind the bearing raceway 7 on the hub ring 2*a*, the fitting surface 10*a* for the raceway member 2*b* and the seal land 10*b* by bringing a grinder 22 into abutment with the bearing raceway 7 on the hub ring 2*a*, the fitting surface 10*a* and abutment surface for the raceway member 2*b* and the seal land 10*b* and rotating the hub ring 2*a*.

It is provided with a chucking device 31 for holding the brake pilot portion 9*b* of the hub ring 2*a*, a backing plate 32 to be brought into abutment with the outer side face of the wheel-mounting flange 6, and a pressure clamp 33 for axially biasing the end face of the small-diameter portion 10 of the hub ring 2*a* to clamp the hub ring 2*a* from both sides during grinding.

The chucking device 31 comprises a tubular collet holder 34, a spring collet 35 mounted in the collet holder 34, and a drawbar 36 for axially moving the spring collet 35.

On the outer periphery of the drawbar 36 at its tip, a protrusion 37 is formed which is in engagement with an annular groove 38 formed in the inner peripheral surface of the spring collet 35 at its rear end.

The chucking device 31 moves the spring collet 35 back and forth by the axial movement of the drawbar 36. When it retracts, it shrinks the tip of the spring collet 35 by contact between a tapered surface 39 formed on the inner peripheral surface of the collet holder 34 at its tip and a tapered surface 40 formed on the outer peripheral surface of the spring collet 35 at its tip to clamp the cylindrical outer peripheral surface of the brake pilot portion 9*b*.

In the spring collet 35, a centering cone 42 of a centering device 41 is mounted. It is fixed to the collet holder 34 through a leg 43 by means of a bolt 44.

The centering cone 42 shown in FIG. 1 has at its tip an annular ring portion 42*a* for guiding the outer peripheral surface of the wheel pilot portion 9*a* so that the tip of the annular ring portion 42*a* will be supported by the side face at the root of the brake pilot portion 9*b*.

Figure 2:
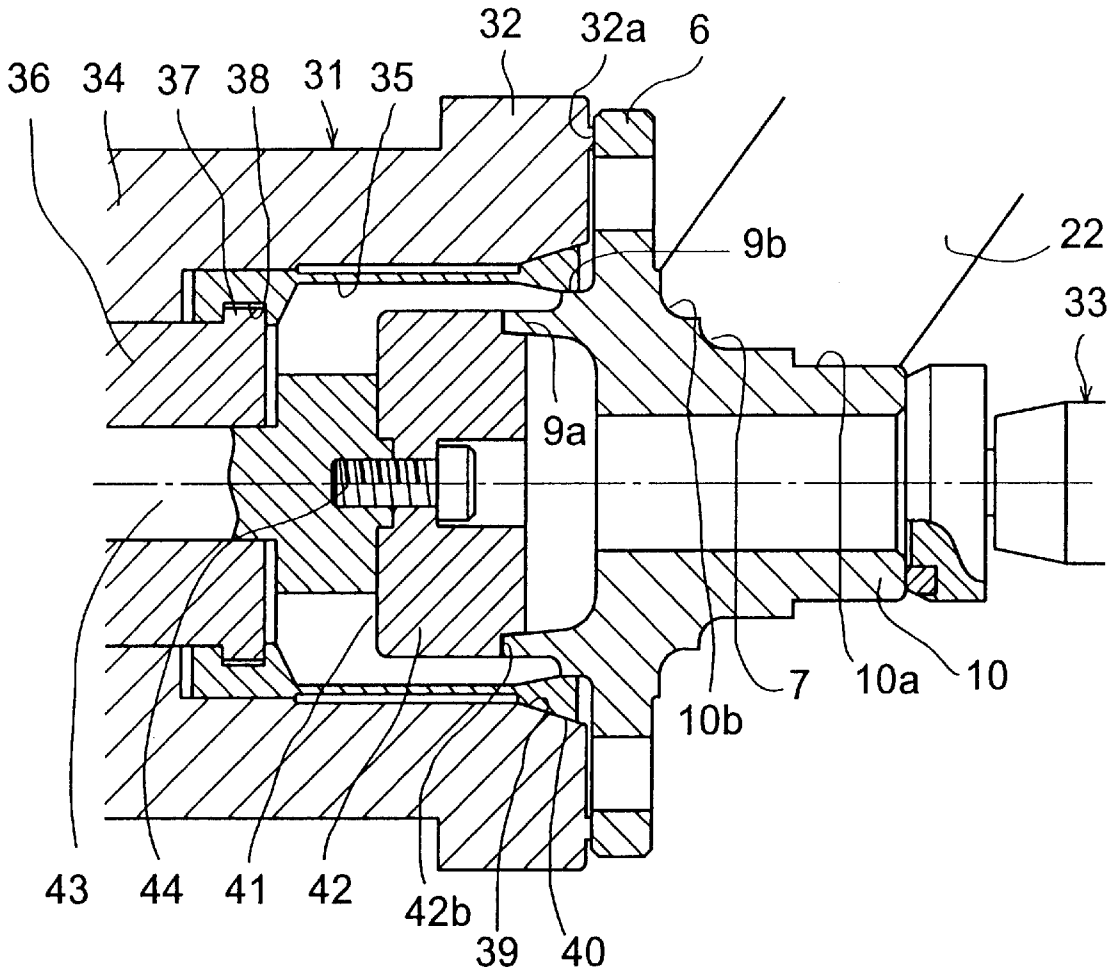
FIG. 2 is a cross-sectional plan view of the rotary grinding device of FIG. 1 showing a modified example of the centering cone.

FIG. 2 shows another form of the centering cone 42, which has an annular shoulder portion 42*b* for guiding the inner peripheral surface of the wheel pilot portion 9*a*, and the inner end of the annular shoulder portion 42*b* is adapted to support the end face of the wheel pilot portion 9*a*.

By fitting the centering cone 42 on the wheel pilot portion 9*a* before the centering cone 42 shrinks the tip of the spring collet 35 to clamp the cylindrical outer peripheral surface of the brake pilot portion 9*b*, the hub ring 2*a* can be positioned into alignment.

At the tip of the tubular collet holder 34, a backing plate 32 is integrally formed to be brought into abutment with the outer side face of the wheel-mounting flange 6. At a portion of the backing plate 32 near its outer periphery, a circumferential support portion 32*a* to be brought into abutment with the outer peripheral portion of the wheel-mounting flange 6 is formed to prevent the backing plate 32 from contacting the wheel-mounting flange 6 over the entire surface. With this arrangement, it is possible to minimize the contact area between the wheel-mounting flange 6 and the backing plate 32 and to grind the hub ring 2*a* without being influenced by the working accuracy of the wheel-mounting flange 6 in the previous step or by biting of foreign matter.

By forming a plurality of the support portions 32*a* on the backing plate 32 in a circumferential direction, rotary support of the hub ring 2*a* will stabilize more, so that high-precision grinding is assured.

Figure 3:
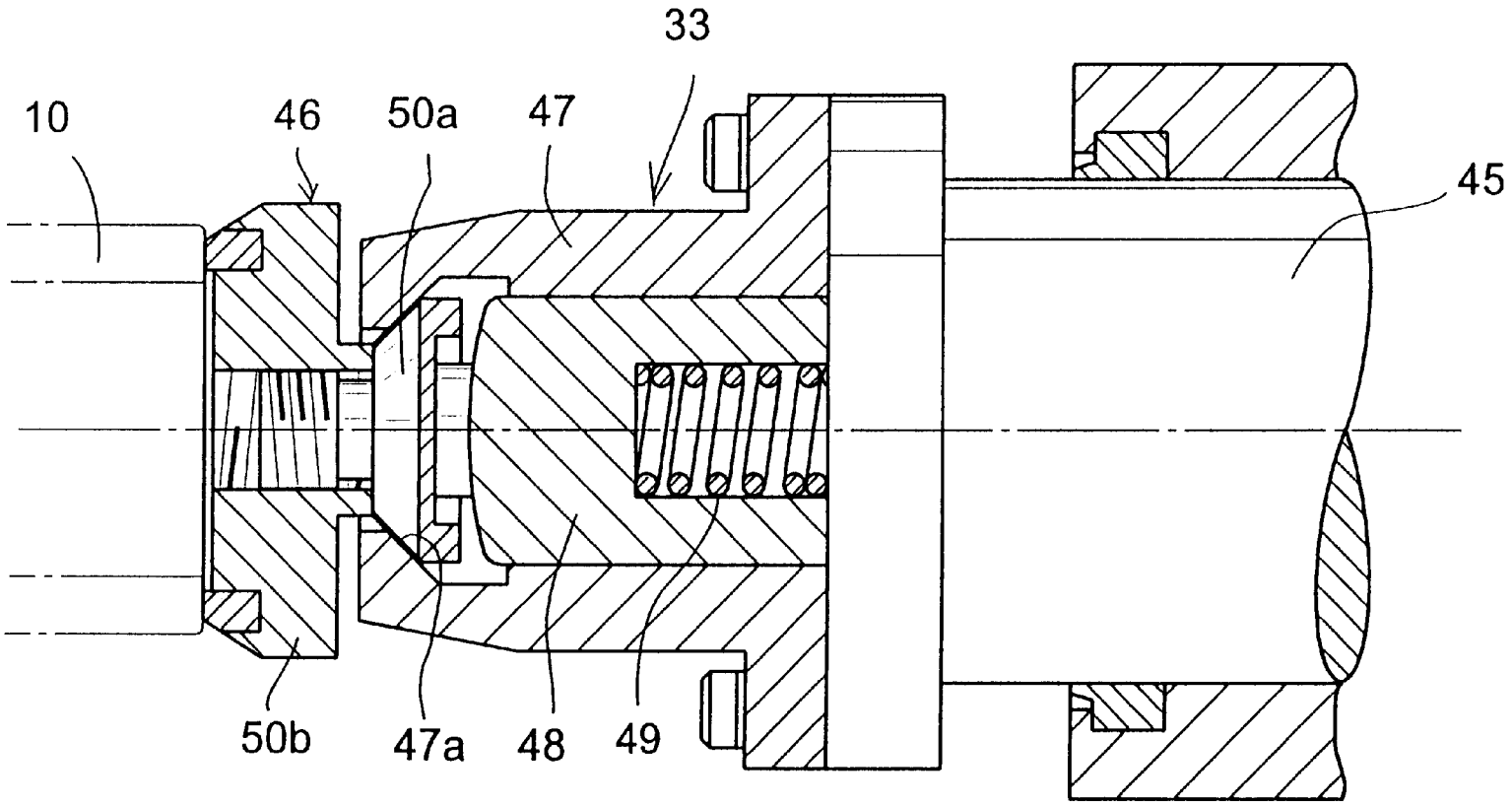
FIG. 3 is an enlarged cross-sectional plan view showing the pressure clamp portion.

On the other hand, as shown in FIG. 3, the pressure clamp 33 for axially urging the end face of the small-diameter portion 10 of the hub ring 2*a* has a pushrod 45 that is moved axially by e.g. an air cylinder. At the tip of the pushrod 45, a clamp head 46 is provided so as to be pivotable. While advancing, it biases the end face of the small-diameter portion 10 of the hub ring 2*a* with its tip.

The clamp head 46 comprises a tubular holder portion 47, a rotor shaft 48 housed in the holder portion 47 and biased forward by a spring 49, and a head portion 50*b* having a small-diameter flange portion 50*a* held by an inwardly extending flange portion 47*a* at the front end of the holder portion 47. The rotor shaft 48 has its front end face formed into a spherical surface. The small-diameter flange portion 50*a* has its rear surface in abutment with the spherical surface so that the head portion 50*b* can pivot relative to the center of axis. The abutment surfaces of the inwardly extending flange portion 47*a* of the holder portion 47 and the small-diameter flange portion 50*a* are formed into tapered surfaces.

Figure 4:
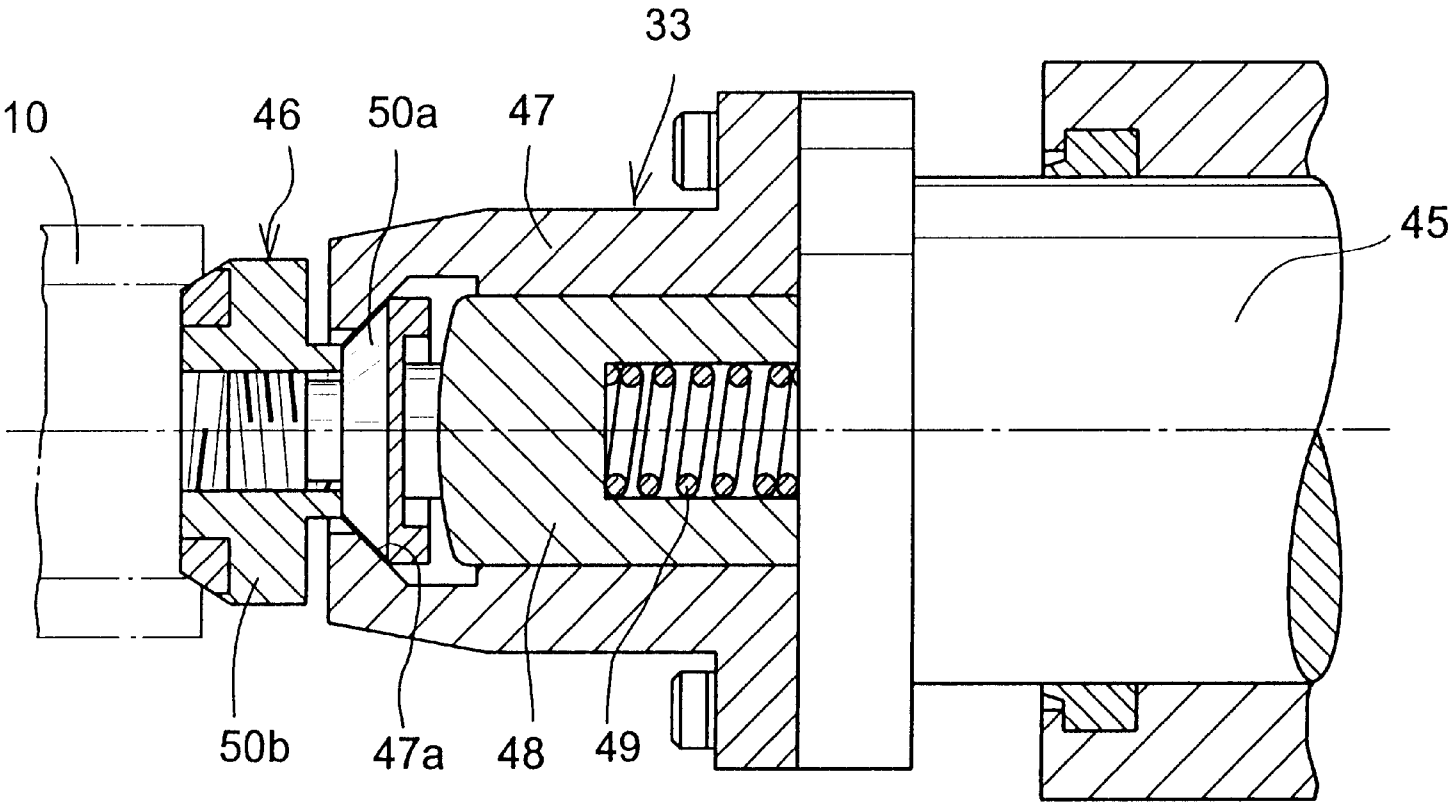
FIG. 4 is a similar view showing another example of a pressure clamp portion.

The head portion 50*b* is of such a size as to abut the end face of the small-diameter portion 10 of the hub ring 2*a* as shown in FIG. 3, or as to be fitted in the small-diameter portion 10 of the hub ring 2*a* as shown in FIG. 4.

The rotary grinding device shown in FIG. 1 is of the above structure. In grinding the hub ring 2*a*, the wheel pilot portion 9*a* of the hub ring 2*a* is fitted in the centering cone 42 to use the brake pilot portion 9*b* of the hub ring 2*a* as a guide when inserting the spring collet 35. After the hub ring 2*a* has been guided by the centering cone 42, the pushrod 45 is advanced (FIG. 3) to bias the small-diameter portion 10 of the hub ring 2*a* by the clamp head 46 of the pressure clamp 33. Thereby the outer surface of the wheel-mounting flange 6 of the hub ring 2*a* is pressed against the backing plate 32 at the tip of the collet holder 34 to clamp the hub ring 2*a* between the backing plate 32 and the pressure clamp 33 under pressure. The biasing force of the pressure clamp 33 is controlled so as to be large during rough grinding of the hub ring 2*a* and small during fitting and precise grinding.

After the hub ring 2*a* has been clamped under low pressure between the backing plate 32 and the pressure clamp 33, the drawbar 36 is retracted (leftwardly in FIG. 1) to shrink the diameter of the spring collet 35 by the movement of the tapered surface 40 on the spring collet 35 relative to the tapered surface 39 on the collet holder 34 to clamp the outer peripheral surface of the brake pilot portion 9*b* of the hub ring 2*a*. The pressure clamp 33 is then changed over to high pressure.

With the hub ring 2*a* clamped from both sides in the axial direction, by bringing the grinder 22 into abutment with the bearing raceway 7 on the hub ring 2*a*, the fitting surface 10*a* and abutment surface for the raceway member 2*b*, and the seal land 10*b*, and rotating the hub ring 2*a*, these surfaces will be ground simultaneously. Because the bearing raceway 7 is ground with the outer side face of the wheel-mounting flange 6 as a reference, even if there exists off-center or run-out of the wheel-mounting flange 6 during prior working step, it will be corrected or removed by grinding.

After grinding, by retracting the pressure clamp 33, releasing the pressure to the hub ring 2*a*, and advancing the drawbar 36 (rightwardly in FIG. 1) to move the tapered surface 40 on the spring collet 35 relative to the tapered surface 39 on the collet holder 34, the spring collet 35 will be expanded. Now the hub ring 2*a* can be removed from the grinding device.

Figure 5:
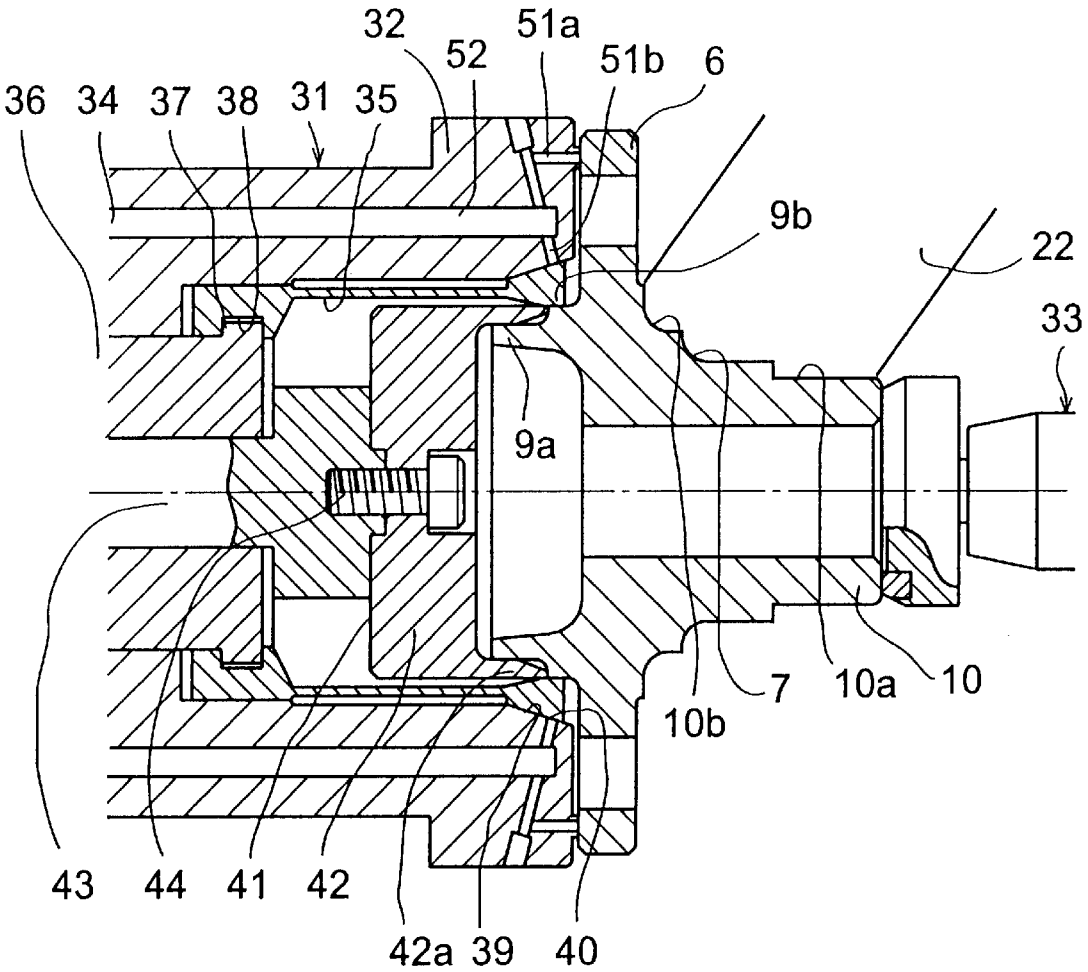
FIG. 5 is an enlarged cross-sectional plan view showing another embodiment.
Figure 6:
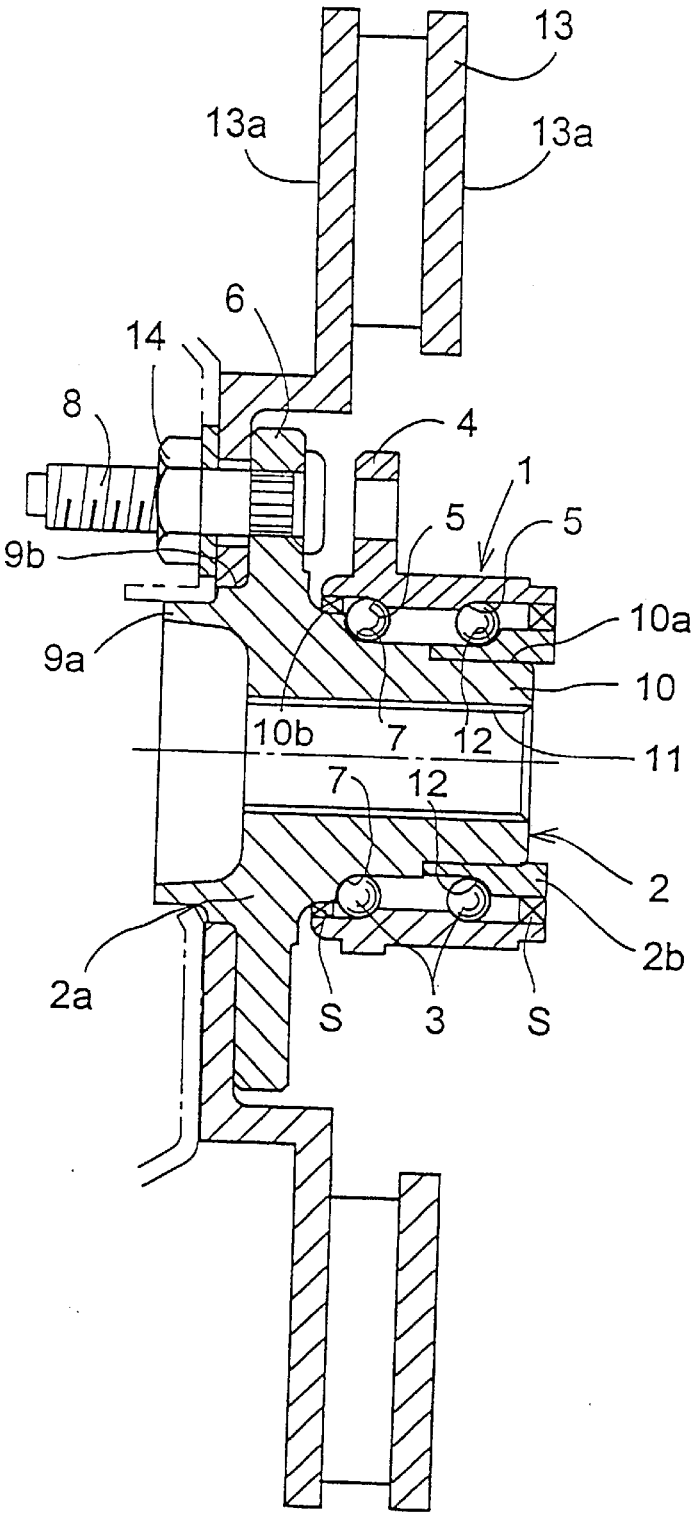
FIG. 6 PRIOR ART
FIG. 6 is a sectional view of a conventional wheel bearing assembly.
Figure 7:
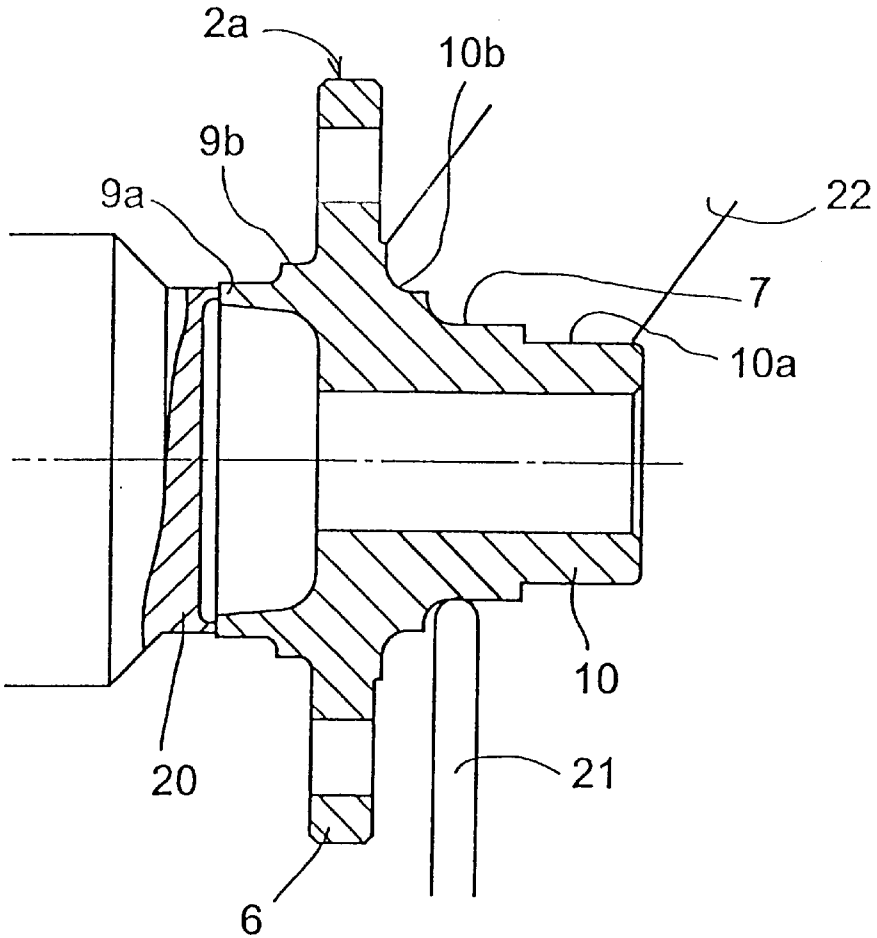
FIG. 7 PRIOR ART
FIG. 7 is a cross-sectional plan view showing a conventional rotary grinding assembly.

Next, the rotary grinding device shown in FIG. 5 is another embodiment in which in order to prevent trouble in fitting of the hub ring 2*a* due to foreign matter caught between the backing plate 32 and the wheel-mounting flange 6 or in the chucking device 31 for holding the brake pilot portion 9*b*, air nozzles 51*a*, 51*b* are provided in the backing plate 32 to blow air against the support portion of the wheel-mounting flange 6 and the clamp portion of the brake pilot portion 9*b*. In FIG. 5, numeral 52 shows a compressed air supply passage.

When the backing plate 32 is brought into abutment with the outer side face of the wheel-mounting flange 6, a closed space is formed inside of it. Thus, by supplying air into the closed space from the air nozzles 51*a* and 51*b* and detecting the air pressure, it is possible to check for biting of foreign matter or fitting trouble. That is to say, if foreign matter should be caught between the wheel-mounting flange 6 and the backing plate 32, air pressure will drop due to air leakage. Thus, by monitoring the air pressure, it is possible to check poor fitting of the hub ring.

Also, the air blown from the air nozzle 51*b* can remove foreign matter stuck on the clamp portion of the brake pilot portion 9*b* of the hub ring 2*a*.

As described above, according to this invention, while ensuring coaxiality of the hub ring with the outer side face of the wheel-mounting flange as a reference, it is possible to grind at least the bearing raceway. Thus, without performing secondary turning, a high-precision hub ring can be provided in which the run-out accuracy of the flange surface as the brake rotor-mounting surface and the coaxiality of the brake pilot portion have been improved.

What is claimed is:

1. A method for working a hub ring of a wheel bearing assembly, the hub ring having integral therewith a wheel-mounting flange, a brake pilot portion protruding from a root of the wheel-mounting flange, and a small-diameter portion including a bearing raceway on an outer periphery of the small-diameter portion, said method comprising:

clamping said brake pilot portion;

using a pressure clamp to axially bias an end face of said small-diameter portion so as to abut an outer side face of said wheel-mounting flange with a backing plate; and with said brake pilot portion clamped and said outer side face of said wheel-mounting flange abutting said backing plate, grinding said bearing raceway while using said outer side face of said wheel-mounting flange as a reference surface.

2. The method according to claim 1, wherein said backing plate includes a support portion, and using a pressure clamp to axially bias an end face of said small-diameter portion so as to abut an outer side face of said wheel-mounting flange with a backing plate comprises using said pressure clamp to axially bias said end face of said small-diameter portion so as to abut an outer peripheral portion of said outer side face of said wheel-mounting flange with said support portion of said backing plate.

3. The method according to claim 2, wherein said backing plate includes air nozzles formed therein, and further comprising:

blowing air through said air nozzles, as necessary, to remove foreign matter adhering to said backing plate.

4. The method according to claim 2, wherein said backing plate includes air nozzles formed therein, and further comprising:

blowing air through said air nozzles, as necessary, to remove foreign matter adhering to said brake pilot portion.

5. The method according to claim 2, wherein said pressure clamp includes, at a tip portion of said pressure clamp, a clamp head which is pivotable along a spherical surface, and using a pressure clamp to axially bias an end face of said small-diameter portion so as to abut an outer side face of said wheel-mounting flange with a backing plate comprises using said clamp head to axially bias said end face of said small-diameter portion so as to abut said outer side face of said wheel-mounting flange with said backing plate.

6. The method according to claim 1, wherein said backing plate includes plural circumferentially arranged support portions, and using a pressure clamp to axially bias an end face of said small-diameter portion so as to abut an outer side face of said wheel-mounting flange with a backing plate comprises using said pressure clamp to axially bias said end face of said small-diameter portion so as to abut an outer peripheral portion of said outer side face of said wheel-mounting flange with said circumferentially arranged support portions of said backing plate.

7. The method according to claim 6, wherein said backing plate includes air nozzles formed therein, and further comprising:

blowing air through said air nozzles, as necessary, to remove foreign matter adhering to said backing plate.

8. The method according to claim 6, wherein said backing plate includes air nozzles formed therein, and further comprising:

blowing air through said air nozzles, as necessary, to remove foreign matter adhering to said brake pilot portion.

9. The method according to claim 6, wherein said pressure clamp includes, at a tip portion of said pressure clamp, a clamp head which is pivotable along a spherical surface, and using a pressure clamp to axially bias an end face of said small-diameter portion so as to abut an outer side face of said wheel-mounting flange with a backing plate comprises using said clamp head to axially bias said end face of said small-diameter portion so as to abut said outer side face of said wheel-mounting flange with said backing plate.

10. The method according to claim 1, wherein said backing plate includes air nozzles formed therein, and further comprising:

blowing air through said air nozzles, as necessary, to remove foreign matter adhering to said backing plate.

11. The method according to claim 10, wherein using a pressure clamp to axially bias an end face of said small-diameter portion so as to abut an outer side face of said wheel-mounting flange with a backing plate results in a closed space being defined between said backing plate and said outer side face of said wheel-mounting flange, and further comprising:

blowing air through said air nozzles into said closed space;

detecting air pressure in said closed space; and using the detected air pressure to determine whether said outer side face of said wheel-mounting flange correctly abuts said backing plate.

12. The method according to claim 11, wherein said pressure clamp includes, at a tip portion of said pressure clamp, a clamphead which is pivotable along a spherical, and using pressure clamp to axially bias an end face of said small-diameter portion so as to abut an outer face of said wheel-mounting flange with a backing plate comprises using said clamp head to axially bias end face of said small-diameter portion so as to abut said outer side face of said wheel-mounting flange with said backing plate.

13. The method according to claim 10, further comprising:

blowing air through said air nozzles, as necessary, to remove foreign matter adhering to said brake pilot portion.

14. The method according to claim 10, wherein said pressure clamp includes, at a tip portion of said pressure clamp, a clamp head which is pivotable along a spherical surface, and using a pressure clamp to axially bias an end face of said small-diameter portion so as to abut an outer side face of said wheel-mounting flange with a backing plate comprises using said clamp head to axially bias said end face of said small-diameter portion so as to abut said outer side face of said wheel-mounting flange with said backing plate.

15. The method according to claim 1, wherein said backing plate includes air nozzles formed therein, and further comprising:

blowing air through said air nozzles, as necessary, to remove foreign matter adhering to said brake pilot portion.

16. The method according to claim 15, wherein using a pressure clamp to axially bias an end face of said small-diameter portion so as to abut an outer side face of said wheel-mounting flange with a backing plate results in a closed space being defined between said backing plate and said outer side face of said wheel-mounting flange, and further comprising:

blowing air through air nozzles into said closed space;

detecting air pressure in said closed space; and using the detected air pressure to determine whether said outer side face of said wheel-mounting flange correctly abuts said backing plate.

17. The method according to claim 15, wherein said pressure clamp includes, at a tip portion of said pressure clamp, a clamp head which is pivotable along a spherical surface, and using a pressure clamp to axially bias an end face of said small-diameter portion so as to abut an outer side face of said wheel-mounting flange with a backing plate comprises using said clamp head to axially bias said end face of said small-diameter portion so as to abut said outer side face of said wheel-mounting flange with said backing plate.

18. The method according to claim 1, wherein said pressure clamp includes, at a tip portion of said pressure clamp, a clamp head which is pivotable along a spherical surface, and using a pressure clamp to axially bias an end face of said small-diameter portion so as to abut an outer side face of said wheel-mounting flange with a backing plate comprises using said clamp head to axially bias said end face of said small-diameter portion so as to abut said outer side face of said wheel-mounting flange with said backing plate.

19. A rotary grinding apparatus for grinding a hub ring of a wheel bearing assembly, the hub ring having integral therewith a wheel-mounting flange, a brake pilot portion protruding from a root of the wheel-mounting flange, and a small-diameter portion including a bearing raceway on an outer periphery of the small-diameter portion, said apparatus comprising:

a clamp device including a chuck for holding the brake pilot portion;

a backing plate to be brought into abutment with an outer side face of the wheel-mounting flange;

a pressure clamp for axially biasing an end face of the small-diameter portion; and a grinder for grinding the bearing raceway.

20. The rotary grinding apparatus according to claim 19, further comprising:

a support portion on said backing plate, such that said backing plate is to be brought into abutment with the outer side face of the wheel-mounting flange by having said support portion abut the outer side face of the wheel-mounting flange.

21. The rotary grinding apparatus according to claim 19, further comprising:

circumferentially arranged support portions on said backing plate, such that said backing plate is to be brought into abutment with the outer side face of the wheel-mounting flange by having said circumferentially arranged support portions abut the outer side face of the wheel-mounting flange.

22. The rotary grinding apparatus according to claim 19, further comprising:

air nozzles, in said backing plate, for allowing air to be blown through said air nozzles so as to remove foreign matter adhering to said backing plate.

23. The rotary grinding apparatus according to claim 19, further comprising:

air nozzles, in said backing plate, for allowing air to be blown through said air nozzles so as to remove foreign matter adhering to the brake pilot portion.

24. The rotary grinding apparatus according to claim 19, wherein said pressure clamp includes, at a tip portion of said pressure clamp, a clamp head which is pivotable along a spherical surface.

* * * * *